US007340788B1

(12) United States Patent
Traub

(10) Patent No.: US 7,340,788 B1
(45) Date of Patent: Mar. 11, 2008

(54) METHOD TO IMPROVE THE FIRMNESS OF A PILLOWTOP MATTRESS

(76) Inventor: Christine M. Traub, 3079 Bayberry Way, Margate, FL (US) 33063

( * ) Notice: Subject to any disclaimer, the term of this patent is extended or adjusted under 35 U.S.C. 154(b) by 10 days.

(21) Appl. No.: 11/308,653

(22) Filed: Apr. 18, 2006

(51) Int. Cl.
*A47G 9/04* (2006.01)

(52) U.S. Cl. ..... 5/697; 5/496; 5/658; 5/922; 5/923; 5/482

(58) Field of Classification Search ..... 5/737, 5/922, 697, 496, 498, 982, 690, 658, 923
See application file for complete search history.

(56) References Cited

U.S. PATENT DOCUMENTS

| | | | | |
|---|---|---|---|---|
| 2,923,014 | A * | 2/1960 | Hume | 5/498 |
| 3,893,198 | A * | 7/1975 | Blair | 5/699 |
| 4,424,600 | A | 1/1984 | Callaway | |
| 4,445,242 | A * | 5/1984 | Bowen | 5/484 |
| 4,538,312 | A * | 9/1985 | Marki et al. | 5/499 |
| 4,627,363 | A * | 12/1986 | Jones | 108/90 |
| 4,768,247 | A * | 9/1988 | Beier | 5/640 |
| 4,843,666 | A | 7/1989 | Elesh et al. | |
| 5,081,728 | A | 1/1992 | Skinner | |
| 5,327,595 | A * | 7/1994 | Allen | 5/692 |
| 5,504,952 | A | 4/1996 | Ovadia | |
| 5,513,402 | A | 5/1996 | Schwartz | |
| 5,608,931 | A | 3/1997 | Gancy | |
| 5,782,531 | A * | 7/1998 | Shindle | 297/230.1 |
| 6,301,729 | B1 * | 10/2001 | Hall | 5/494 |
| 6,381,812 | B1 * | 5/2002 | Crider et al. | 24/306 |
| 7,117,553 | B2 * | 10/2006 | Fairchild et al. | 5/655 |

* cited by examiner

*Primary Examiner*—Alexander Grosz
(74) *Attorney, Agent, or Firm*—Malin Haley DiMaggio Bowen & Lhota, P.A.

(57) ABSTRACT

A method for increasing the firmness of a pillowtop or any other soft mattress. The method includes providing a rectangular sheet of cotton fabric material having hook fasteners on one end and loop fasteners on an opposite end to attach the sheet of material around the mattress. The firmness of the mattress is increased by tightly wrapping the sheet of material around the mattress using the fasteners. The sheet of material is sized appropriately to fit entirely around the mattress with overlap. Preferably, the sheet of material is sized and manufactured for wrapping longitudinally around the mattress.

6 Claims, 3 Drawing Sheets

METHOD TO IMPROVE THE FIRMNESS OF A PILLOWTOP MATTRESS

FIELD OF THE INVENTION

The invention is for a method used to increase the firmness of a pillowtop mattress or any other mattress perceived to be too soft by providing an elongated sheet of material having two ends with an adjustable fastener on each end for securing the sheet of material tightly around and over the mattress to compress the pillowtop mattress.

DESCRIPTION OF RELATED ART

In recent years, pillowtop mattresses have increased in popularity over standard firm mattresses and often comprise the largest percentage of mattress sales by furniture and mattress stores. While consumers are attracted initially in the store to the softness of the pillowtop, many individuals soon find that the pillowtop mattress lacks the firmness and support to permit comfort in bed.

U.S. Pat. No. 5,608,931, issued to Gancy on Mar. 11, 1997, describes spring-like couplings of flexible walls of inflatable body supports, wherein an air mattress includes elastic bands to control the movement of walls enclosing the chamber inside said air mattress. The elastic bands are attached at spaced intervals to the walls either inside or outside of the chamber. The elastic bands exert a force that resiliently opposes movement of the walls outward in response to the exertion of an external force to the mattress, and in this manner, said elastic bands maintain the firmness of the air mattress.

U.S. Pat. No. 5,513,402, issued to Schwartz on May 7, 1996, describes a mattress system having a plurality of stacked individual mattress elements. Separation sheets are located between each of the stacked mattress elements to permit said mattress elements to compress and flex separately.

U.S. Pat. No. 5,504,952, issued to Ovadia on Apr. 9, 1996, describes a bed having a user variable degree of hardness, said bed having a mattress overlying a base with a plurality of cross-pieces traversing a rectangular frame. The firmness of the mattress is controlled by varying the number of cross-pieces positioned across the frame as well as by adjusting the amount or density of filling inside the mattress.

U.S. Pat. No. 5,081,728, issued to Skinner on Jan. 21, 1992, describes a mattress and mattress cover comprising numerous mattress blocks that are held together in parallel by a mattress cover.

U.S. Pat. No. 4,843,666, issued to Elesh et al., on Jul. 4, 1989, describes a pillow mattress comprising an open foamed plastic box containing a plurality of pillows of various densities.

U.S. Pat. No. 4,424,600, issued to Callaway on Jan. 10, 1984, describes an adjustable firmness mattress pillowtop that includes a removable pillowtop component that is fastened to the top of the body of the mattress and a thin fluid inflatable cushion that is located below the pillowtop. The pressure of the fluid inside the inflatable cushion can be increased or decreased to change the firmness of the mattress as desired.

None of the above devices in the prior art provide for increasing the firmness of a pillowtop mattress.

SUMMARY OF THE INVENTION

A method for increasing the firmness of a pillowtop mattress by providing a rectangular sheet of fabric material sized in length to wrap completely around the mattress in one direction with overlap, the overlapped first and second ends having hook and pile fastening strips for connection to each other.

The compressor sheet width is sized to cover the width of the mattress surface. The first end fastener strips are comprised of one or more strips of the hook material connected to the first end of the fabric sheet perpendicular to the longitudinal axis of the fabric sheet on a first side of the fabric sheet.

The second end fastener strips are comprised of one or more strips of pile material and are connected to the second end of the fabric sheet perpendicular to the longitudinal axis of the fabric sheet on the second side of the fabric sheet.

To install the pillowtop mattress compressor, the fabric sheet is wrapped completely around the mattress from top to bottom (head to foot) until the first and second ends of the fabric sheet overlap. The first and second ends of the fabric sheet are pulled together manually to compress the pillowtop portion making the pillowtop area more firm while engaging one or more pile strip fasteners with one or more hook fastener strips while the fabric sheet is taut.

The overlapped fabric sheet area containing the hook and pile fastening sheets can be positioned near the foot of the mattress on top or on the bottom side away from the sleeping area.

After the mattress compressor is installed directly in contact with the mattress surface, a conventional mattress cover can be installed and then used with top and bottom conventional bed sheets.

Using a plurality of hook and pile fastening strips spaced apart near the first and second ends of the compressor fabric sheet, the amount of tension on the pillowtop area can be adjusted.

The compressor sheet of material is made from cotton as a broadcloth. However, other materials can be used that are man-made or natural fabrics or fibers.

Other fasteners could be employed to connect the compressor sheet first and second ends tautly together including cinching straps, hooks, buttons, zippers or other conventional fasteners.

In an alternate embodiment, the compressor sheet of material can be sized in length to wrap around the lateral or width direction with overlap and the hook and pile fasteners. In this case, the compressor sheet of material is sized in width to reach between the top of the pillowtop mattress and the bottom of the mattress, perpendicular to its length.

It is an object of the invention to provide a method to make the pillowtop mattress more firm for sleeping.

Another object of this invention is to provide an inexpensive, easy and quick method for increasing the firmness of a pillowtop mattress.

In accordance with these and other objects which will become apparent hereinafter, the instant invention will now be described with particular reference to the accompanying drawings.

DETAILED DESCRIPTION

Figure 1:
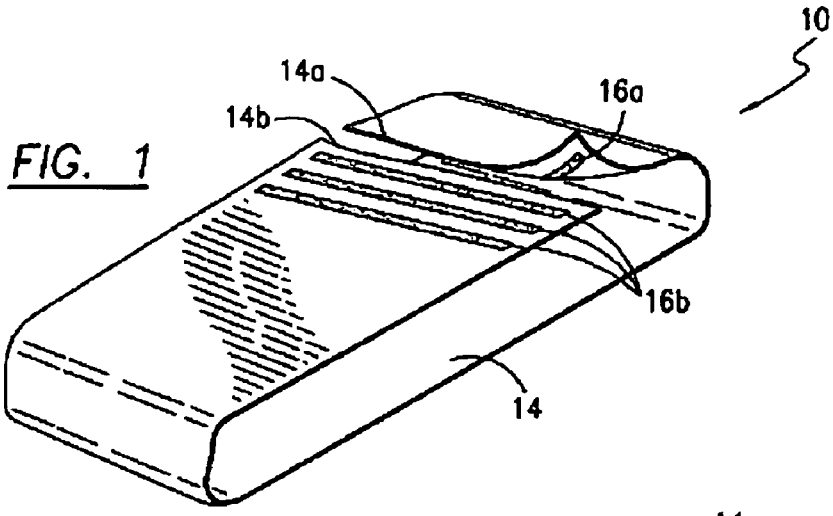
FIG. 1 shows a perspective view of the mattress compressor.

FIG. 1 illustrates a mattress compressor 10 for increasing the firmness of a pillowtop mattress 12. The compressor 10 is used to compress a soft upper pillowtop portion 12*a* of the pillowtop mattress 12 or a soft non-pillowtop mattress. The compressor 10 comprises a rectangular sheet of cotton broadcloth material 14 having a first end 14*a* and a second end 14*b* and hook and pile fastener strips for connecting said first end to said second end to secure the sheet of material completely around the mattress 12 with overlap in the longitudinal direction mounted on opposite sides of the compressor sheet. The hook fasteners 16*a* of the first end 14*a* engage the loop fasteners 16*b* of the second end 14*b* on opposite sides to permit the compressor sheet of material 14 to be fastened tautly and securely around the mattress 12 with the pillowtop area compressed for firmness. Once wrapped tightly and secured around the mattress 12, the compressor sheet of material 14 exerts a uniform pressure on the upper pillowtop portion 12*a* of said pillowtop mattress 12, thereby compressing said pillowtop portion 12*a* and increasing the firmness of the mattress 12. By including more than one, and preferably three, strips 16 of hook fasteners 16*a* as well as one or more strips 16 of loop fasteners 16*b* arranged in parallel strips laterally on the opposite surfaces of the sheet of material 14, said compressor sheet 10 may be adjustably wrapped and tightened around the mattress 12.

The sheet of material 14 is constructed preferably from natural, synthetic, or natural-synthetic blend fabrics due to the ability of these materials to withstand wear and tear. Most preferably, the sheet of material 14 comprises a cotton broadcloth. However, any sturdy plastic, elastomer, or other polymeric sheet of material may also be used for this invention.

Other fasteners 16 may also be used alone or in combination to connect together the first and second ends 14*a* and 14*b* of the sheet of material 14. These include buttons, rivets, studs, buckles, plastic tie strips, elastomer tie strips, fabric tie strips, snap fasteners, snap buttons, zippers, hook and eye fasteners, grommets, safety ties, clamps, adhesive strips or patches, and any other suitable fasteners.

Figure 2:
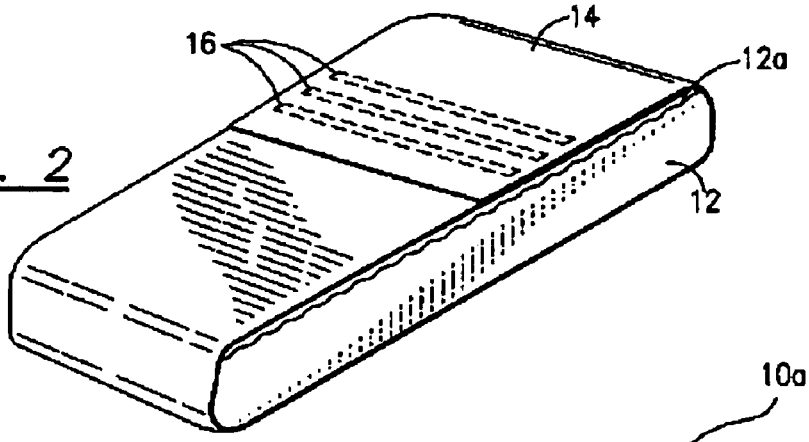
FIG. 2 shows a perspective view of the mattress compressor wrapped longitudinally around a pillowtop mattress.
Figure 3:
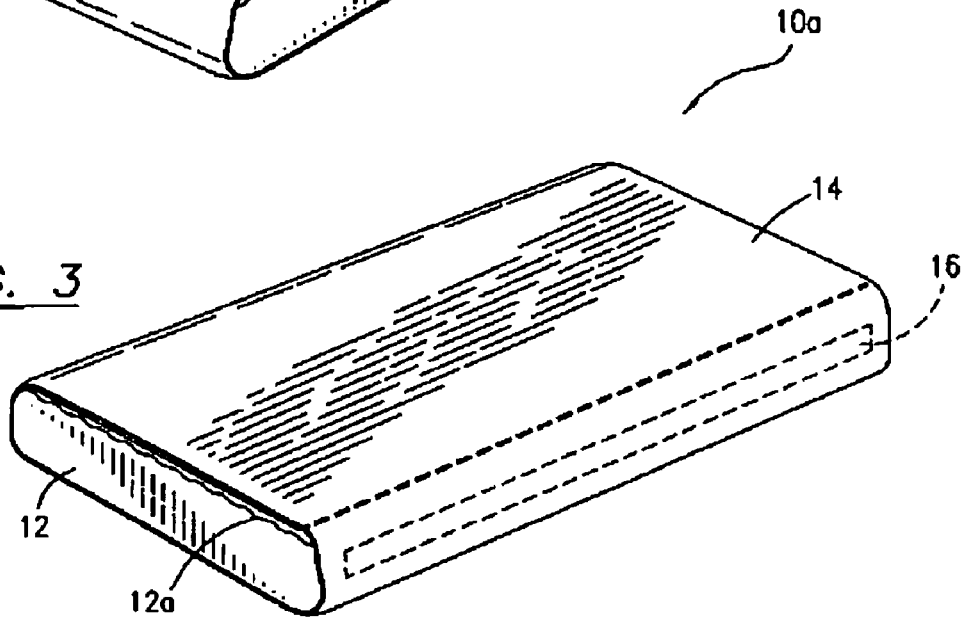
FIG. 3 shows an alternate embodiment of the invention in which the mattress compressor is designed to wrap laterally around a pillowtop mattress.

In the preferred embodiment shown in FIG. 2, the sheet of material 14 is wrapped longitudinally around the mattress 12. However, in another embodiment, said sheet of material 14 may be designed to wrap laterally around the mattress 12 as shown in FIG. 3, or in any other configuration that produces compression of the pillowtop portion 12*a* of the pillowtop mattress 12. Preferably, the sheet of material 14 is sized to be capable of wrapping entirely around the pillowtop mattress 12 while preserving some length of the sheet of material for overlap of the first end 14*a* and second end 14*b* of said sheet of material 14. Thus, the sheet of material 14 must be at least twice the length of the mattress 12 plus two times the distance of the height of the mattress to accommodate two vertical sides of said mattress and must include additional length to provide the overlap necessary for fastening together said first and second ends 14*a* and 14*b*.

In the preferred embodiment comprising a longitudinally wrapping mattress compressor 10, the mattress compressor is manufactured in the following preferred dimensions. For a standard twin bed, the sheet of material must be at least 39 inches wide and more than 150 inches long. For a twin extra long bed, the sheet of material must be at least 39 inches wide and more than 160 inches long. For a double or full bed, the sheet of material must be at least 53 inches wide and more than 150 inches long. For a double extra long bed, the sheet of material must be at least 54 inches wide and more than 160 inches long. For a queen bed, the sheet of material must be at least 60 inches wide and more than 160 inches long. For a king bed, the sheet of material must be at least 76 inches wide and more than 160 inches long. For a California king bed, the sheet of material must be at least 72 inches wide and more than 168 inches long. A standard pillowtop mattress is approximately 16 inches thick. To accommodate the vertical sides of the mattress and to provide the desired overlap for fastening said first and second ends, the mattress compressors are manufactured longer than twice the length of the mattress. Table 1 below shows the dimensions for standard sized pillowtop mattresses and the corresponding preferred dimensions for a mattress compressor for those mattresses. For laterally wrapping mattress compressors 10*a* like that shown in FIG. 3, the width of the sheet of material 14 is doubled rather than the length.

TABLE 1

Pillowtop Mattress and Mattress Compressor Preferred Dimensions

| Mattress Size | Mattress Dimensions (width by length in inches) | Mattress Compressor Preferred Dimensions (width by length in inches) |
|---|---|---|
| Twin | 39" × 75" | 41" × 182" |
| Twin Extra Long | 39" × 80" | 41" × 192" |
| Full (Double) | 54" × 75" | 56" × 182" |
| Full Extra Long | 54" × 80" | 56" × 192" |
| Queen | 60" × 80" | 62" × 192" |
| King | 76" × 80" | 78" × 192" |
| California King | 72" × 84" | 74" × 200" |

In another embodiment, the sheet of material 14 is sized to be capable of wrapping over an entire top horizontal surface of the pillowtop mattress 12 and extends partially around at least two vertical walls of the mattress. In yet another embodiment, the sheet of material is sized to be capable of wrapping over the entire top horizontal surface of the pillowtop mattress extending downward around the vertical walls of the mattress and partially over a bottom horizontal surface of the mattress. In these embodiments of the invention, the fasteners 16, such as strips of hook and loop fasteners, may be attached by adhesive or other suitable methods or structures to one or more surfaces of the mattress, box spring, or bed frame. For example, a plurality of fasteners 16 can be attached to one or more vertical walls of the mattress or box spring, or said fasteners can be attached to a bottom horizontal surface of the mattress or box spring. The first and second ends of the sheet of material would include either all hook fasteners while the mattress or box spring correspondingly would have all loop fasteners or vice versa. Other arrangements are also contemplated, in which the first end of the sheet of material has one or more strips of hook fasteners and the second end has one or more strips of loop fasteners with the mattress or box spring including corresponding loop fasteners on one end and hook fasteners on the opposite end. These arrangements allow the sheet of material to be wrapped and stretched tautly over the top horizontal pillowtop surface of the pillowtop mattress and adjustably fastened to the appropriate corresponding fastening means affixed to the surface of the mattress or box spring.

Figure 5:
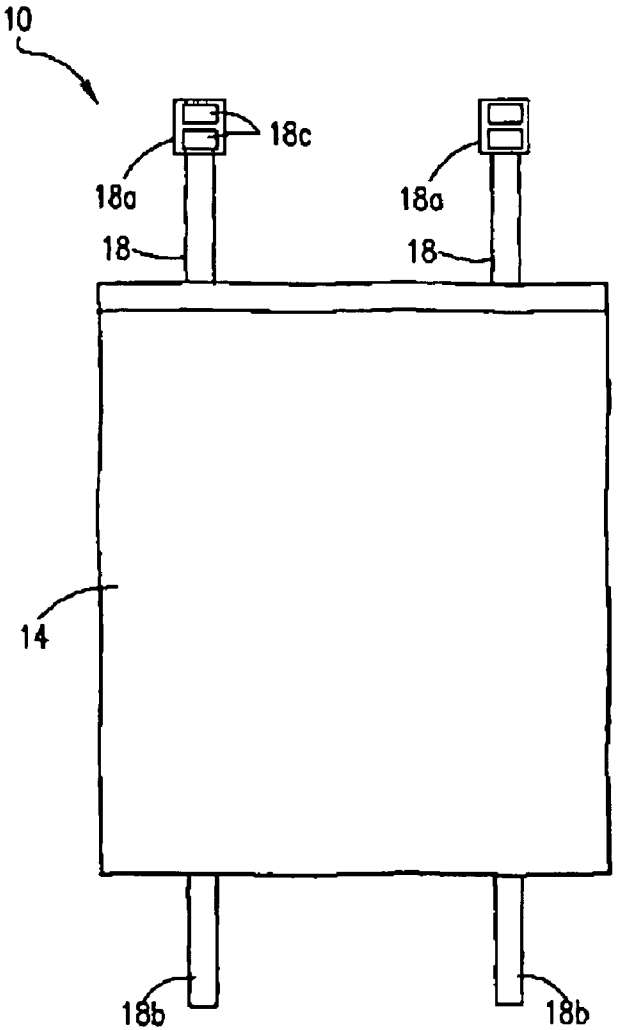
FIG. 5 shows an upper elevational view of the mattress compressor having adjustable tension straps with metal fasteners for wrapping said compressor around a pillowtop mattress.

In another embodiment of the invention shown in FIG. 5, the mattress compressor includes two or more adjustable tension straps 18, each strap having a rigid fastener 18*a* on one end for engaging the opposing loose end 18*b* of the strap on an opposite side of the mattress compressor. The rigid fasteners 18*a* are manufactured preferably from a rigid metal, metal alloy, or plastic. The straps 18 are manufactured preferably from a durable natural or synthetic fiber or polymer. The loose strap end 18*b* is placed through one or more slots 18*c* or other receiving apertures on the rigid fastener 18*a* and pulled tightly to adjust the tension of said straps. By increasing or decreasing the tension of the adjustable tension straps 18, the firmness of the pillow-top mattress 12 is altered.

Figure 6:
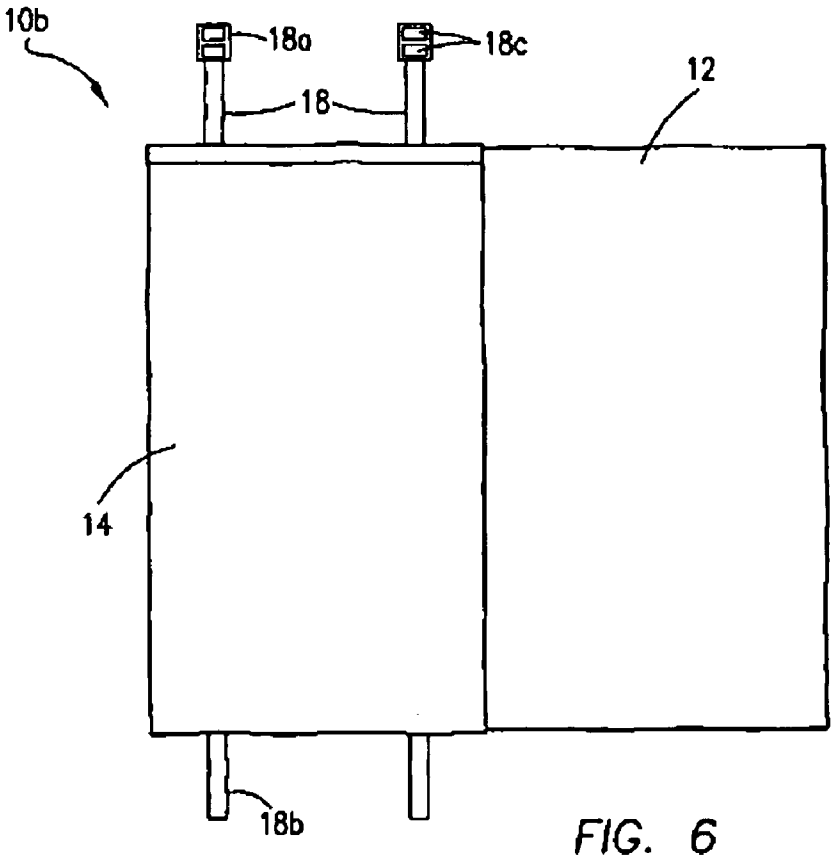
FIG. 6 shows an upper elevational view of a half-sized mattress compressor wrapped around only one-half of a king-sized, queen-sized or double pillowtop mattress.

In still another embodiment of the invention illustrated in FIG. 6, a half-sized mattress compressor 10*b* is wrapped and secured around only one side or one half of a queen-sized, king-sized or double pillowtop mattress 12. The half-sized mattress compressor 10*b* allows an individual resting on one side of the bed to increase the firmness of the pillowtop mattress while an individual on the other side of the bed rests directly on the pillowtop mattress without increasing the firmness of said mattress.

Figure 4:
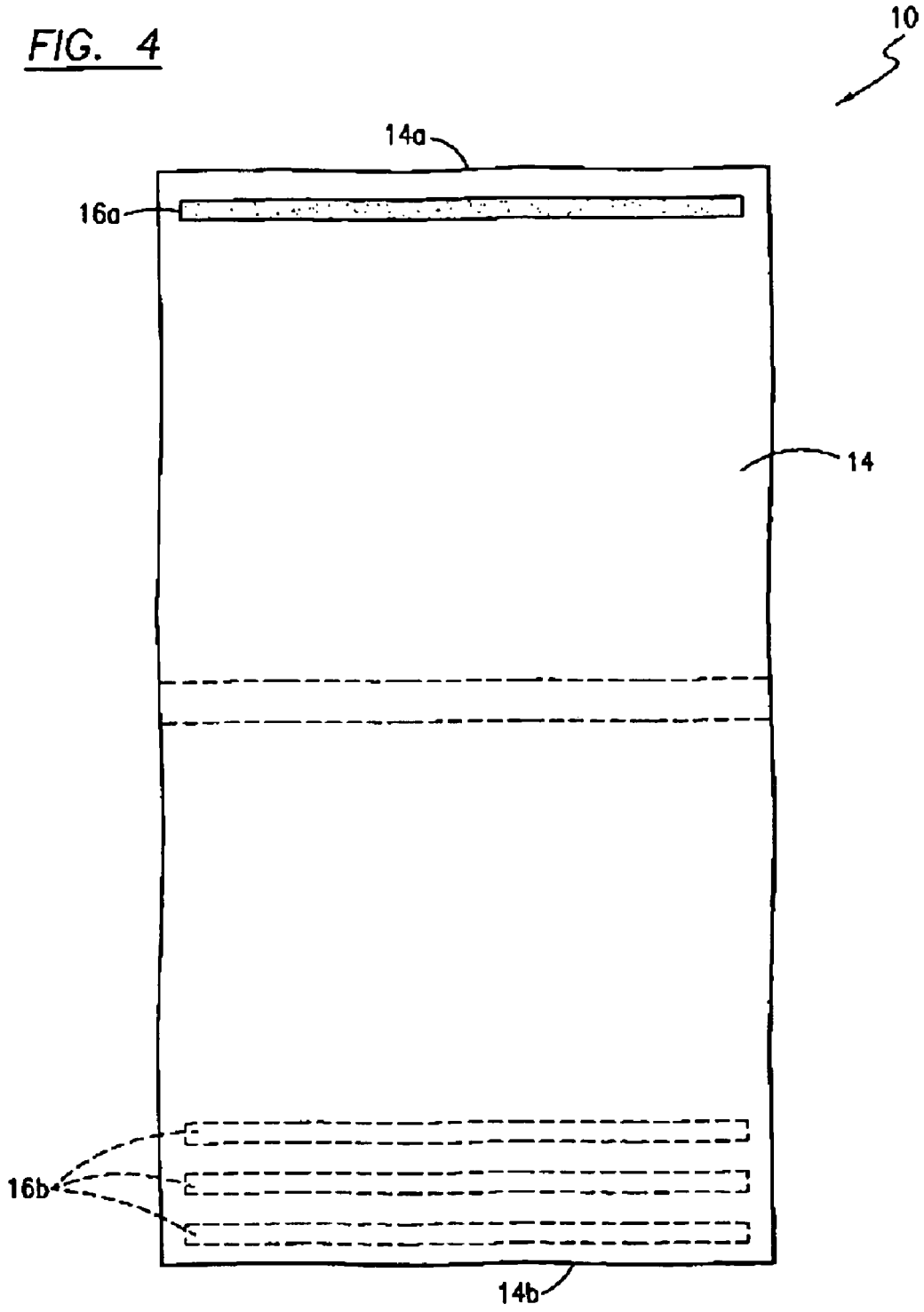
FIG. 4 shows an upper elevational view of the mattress compressor with the strips of fastening means on the second end shown in phantom view.

The invention is also for a method for increasing the firmness of a pillowtop mattress 12. The method comprises the steps of compressing a soft upper pillowtop portion 12*a* of a pillowtop mattress 12 by tightly wrapping the pillowtop mattress in a sheet of material 14 having a first end 14*a* and a second end 14*b*, and attaching the first end of the sheet of material to the second end to maintain a tight wrap around the pillowtop mattress. The first end 14*a* and second end 14*b* of the sheet of material 14 may include any of the fasteners 16 described above, but preferably, includes one or more strips 16 of hook fasteners 16*a* attached on one side of the sheet of material at said first end 14*a* and one or more strips 16 of loop fasteners 16*b* attached on an opposite side of said sheet of material at said second end 14*b* as illustrated in FIG. 4.

In the preferred method, the sheet of material 14 is wrapped longitudinally around the pillowtop mattress 12, however, in other embodiments of the invention, the mattress compressor 10*a* may be designed to wrap laterally around the pillowtop mattress or in any other way that permits the pillowtop mattress to be wrapped and compressed. Preferably, the first end 14*a* of one side of the sheet of material 14 includes one strip 16 of hook fasteners 16*a* and the second end 14*b* of the opposite side of said sheet of material includes three laterally-oriented, evenly-spaced strips 16 of loop fasteners 16*b* attached in parallel across the width of said sheet of material. The hook fasteners 16*a* of the first end 14*a* are attached to one of the strips 16 of loop fasteners 16*b* on the second end 14*b*. A user would attach the hook fasteners 16*a* to the strip of loop fasteners 16*b* nearest the edge of the second end 14*b* to increase the firmness of the pillowtop mattress. The tightness of the wrapping, and consequently the firmness of the pillowtop mattress, is increased to an increasingly greater degree by attaching the hook fasteners 16*a* of the first end 14*a* to one of the strips of loop fasteners 16*b* located at increasing distances away from the edge of the second end 14*b* of the sheet of material 14.

The mattress compressor is a non-complex inexpensive device for increasing the firmness of a pillowtop mattress that can be easily installed and removed for cleaning.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A method to improve the firmness of a pillow top mattress of a size adapted to support at least one user comprising the steps of:

providing a pillow top mattress having a particular degree of softness;

providing a rectangular sheet of material sized in area to cover the pillow top mattress top surface;

providing a first adjustable fastener;

providing a second adjustable fastener connectable to said first adjustable fastener;

said rectangular sheet of material including a first end and a second end, said first adjustable fastener attached at or near said sheet of material first end, and said second adjustable fastener attached at or near said sheet of material second end;

placing said sheet of material over said pillow top mattress surface and connecting said first adjustable fastener to said second adjustable fastener on the bottom side of the pillow top mattress; and tightening said first adjustable fastener to said second adjustable fastener causing said sheet of material to increase the firmness of the pillow top mattress by compressing the pillow top surface.

2. In method as in claim 1, including the additional step of:

providing a first adjustable fastener that includes a hook and pile fastener; and providing a second adjustable fastener that includes a hook and pile fastener.

3. A method as in claim 1, including the additional step of:

providing a first adjustable fastener that includes a strap with a buckle; and providing a second adjustable fastener that includes a strap having a series of holes to connect to said buckle of said first fastener.

4. A method as in claim 1 for adjusting the firmness of the pillow top mattress for approximately one half the top surface area of the pillow top mattress comprising the additional step:

reducing the size of the sheet of material to approximately one half the top surface area of the particular pillow top mattress for which the firmness is being increased.

5. A method to improve the firmness of a pillow top mattress of a size adapted to support at least one user comprising the steps of:

providing a pillow top mattress having a top surface, a bottom surface, a front surface, a rear surface, a left side surface and a right side surface:

providing a substantially rectangular sheet of material having a first end and a second end sized in length to cover the top surface and bottom surface of said pillow top mattress and the left side surface and the right side surface of said pillow top mattress and having an additional length such that the first end in the second end of said sheet of material overlap to provide an area for hook and pile fasteners;

at least one hook fastener attached to said sheet of material near said first end of said sheet of material on the top side of said sheet of material and at least one pile fastener attached to said sheet of material near said second end of said sheet of material;

wrapping said sheet of material around said pillow top mattress covering said top surface, said bottom surface, said left side surface, and said right side surface of said pillow top mattress; and increasing the firmness of said pillow top mattress by engaging said first hook fastener at said first end of said sheet of material to said second pile fastener at said second end of said sheet of material.

6. The method as in claim 5 including the additional step of:

providing a plurality of hook fasteners near said first end of said sheet of material and a plurality of pile fasteners near said second end of said sheet of material allowing for adjusting the length of the sheet of material between the fasteners at the first end and at the second end of the sheet of material for adjusting the firmness of the pillow top mattress.

* * * * *